US008634735B2

(12) United States Patent
Ko

(10) Patent No.: US 8,634,735 B2
(45) Date of Patent: Jan. 21, 2014

(54) IMAGE FORMING APPARATUS AND CONTROL METHOD THEREOF

(75) Inventor: Young-Soo Ko, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1140 days.

(21) Appl. No.: 12/268,621

(22) Filed: Nov. 11, 2008

(65) Prior Publication Data

US 2009/0174888 A1 Jul. 9, 2009

(30) Foreign Application Priority Data

Jan. 4, 2008 (KR) ..... 10-2008-0001470

(51) Int. Cl.
*G03G 15/20* (2006.01)

(52) U.S. Cl.
USPC ..... 399/68; 399/70

(58) Field of Classification Search
USPC ..... 399/68
See application file for complete search history.

(56) References Cited

U.S. PATENT DOCUMENTS

| | | | | |
|---|---|---|---|---|
| 7,035,564 | B2 * | 4/2006 | Kietzman et al. | 399/68 |
| 7,054,571 | B2 * | 5/2006 | Camp et al. | 399/68 |
| 7,136,089 | B2 * | 11/2006 | Able et al. | 347/262 |
| 7,313,339 | B2 * | 12/2007 | Nishiyama | 399/68 |
| 2007/0160397 | A1 * | 7/2007 | Kim et al. | 399/322 |
| 2007/0217803 | A1 * | 9/2007 | Nakayama | 399/68 |
| 2008/0012891 | A1 * | 1/2008 | Murashima | 347/16 |
| 2008/0232834 | A1 * | 9/2008 | Tsukamura et al. | 399/45 |

FOREIGN PATENT DOCUMENTS

| | | | | |
|---|---|---|---|---|
| JP | 2001356616 | A * | 12/2001 | |
| JP | 2003-066765 | A | 3/2003 | |
| JP | 2003066765 | A * | 3/2003 | G03G 15/20 |
| JP | 2005003818 | A * | 1/2005 | |
| JP | 2006119426 | A * | 5/2006 | |
| KR | 10-1998-0083887 | A | 12/1998 | |

OTHER PUBLICATIONS

David J. Kappos, Subject Matter Eligibility of Computer Readable Media, Official Gazette of the United States Patent and Trademark Office, 1351 OG 212 (Feb. 23, 2010).*
Korean Office Action mailed May 11, 2012 in co-pending application No. 10-2008-0001470.

* cited by examiner

*Primary Examiner* — David Gray
*Assistant Examiner* — Tyler Hardman
(74) *Attorney, Agent, or Firm* — Staas & Halsey LLP

(57) ABSTRACT

An image forming apparatus includes: an image forming part which picks up a recording medium at a predetermined pickup timing and forms an image at a predetermined printing speed; and a controller which accelerates the timing for picking up the recording medium in advance of the predetermined pickup timing, and which lowers the printing speed so as to allow the printing operation to take place at a lower fusing temperature during warming up from a cold start in order to shorten the first print output time (FPOT).

15 Claims, 4 Drawing Sheets

IMAGE FORMING APPARATUS AND CONTROL METHOD THEREOF

CROSS-REFERENCE TO RELATED APPLICATION

This application claims priority from Korean Patent Application No. 10-2008-0001470, filed on Jan. 4, 2008 in the Korean Intellectual Property Office, the disclosure of which is incorporated herein by reference.

BACKGROUND OF INVENTION

1. Field of Invention

Apparatuses and methods consistent with the present invention relate to an image forming apparatus and a control method thereof, and more particularly, to an image forming apparatus capable of controlling a first print output time (FPOT).

2. Description of the Related Art

An image forming apparatus forms a predetermined image based on print data. For example, referring to FIG. 1, an image forming apparatus 10 forms an image through an image forming part 100 that may include a developing part 120 having a photosensitive body 121; a light scanning unit 123 which emits light to form a latent image on the photosensitive body 121; a developing unit 125 which develops an image with a toner corresponding to the latent image formed on the photosensitive body 121; and a transferring part 130 which transfers the toner developed on the electric-charged photosensitive body 121 to a recording medium M.

The image forming part 100 may further include a fusing part 140 to heat and press the toner on the recording medium, and a medium ejecting part 150 to eject the recording medium to which the toner image is fused.

The fusing part 140 may be heated based on the supplied power, and permanently fixes the toner on the recording medium. The fusing part 140 may be heated to be above a predetermined temperature required for proper fusing of the toner.

The image forming apparatus 10 warms up the heating the fusing part 140 to above the predetermined temperature if a printing job is received during a sleep mode or a power-off mode (hereinafter, referred to as called "cold start printing"). When the warming up is completed, the image forming apparatus 10 may start printing of the print data.

Thus, there is a problem in that the cold start printing has a relatively long standby time before the printing of the first recording medium is completed, i.e., the "first print output time (FPOT)" is long as compared with printing from the ready mode state, in which the fuser may be already warmed up.

SUMMARY OF DISCLOSURE

Accordingly, it is an aspect of the present invention to provide an image forming apparatus and method of controlling the same that are capable of shortening a first print output time (FPOT), and/or of securing fixability of an image on a recording medium.

BRIEF DESCRIPTION OF THE DRAWINGS

The above and/or other aspects of the present invention will become apparent and more readily appreciated from the following description of the embodiments, taken in conjunction with the accompanying drawings, in which.

DETAILED DESCRIPTION OF SEVERAL EMBODIMENTS OF THE INVENTION

Figure 1:
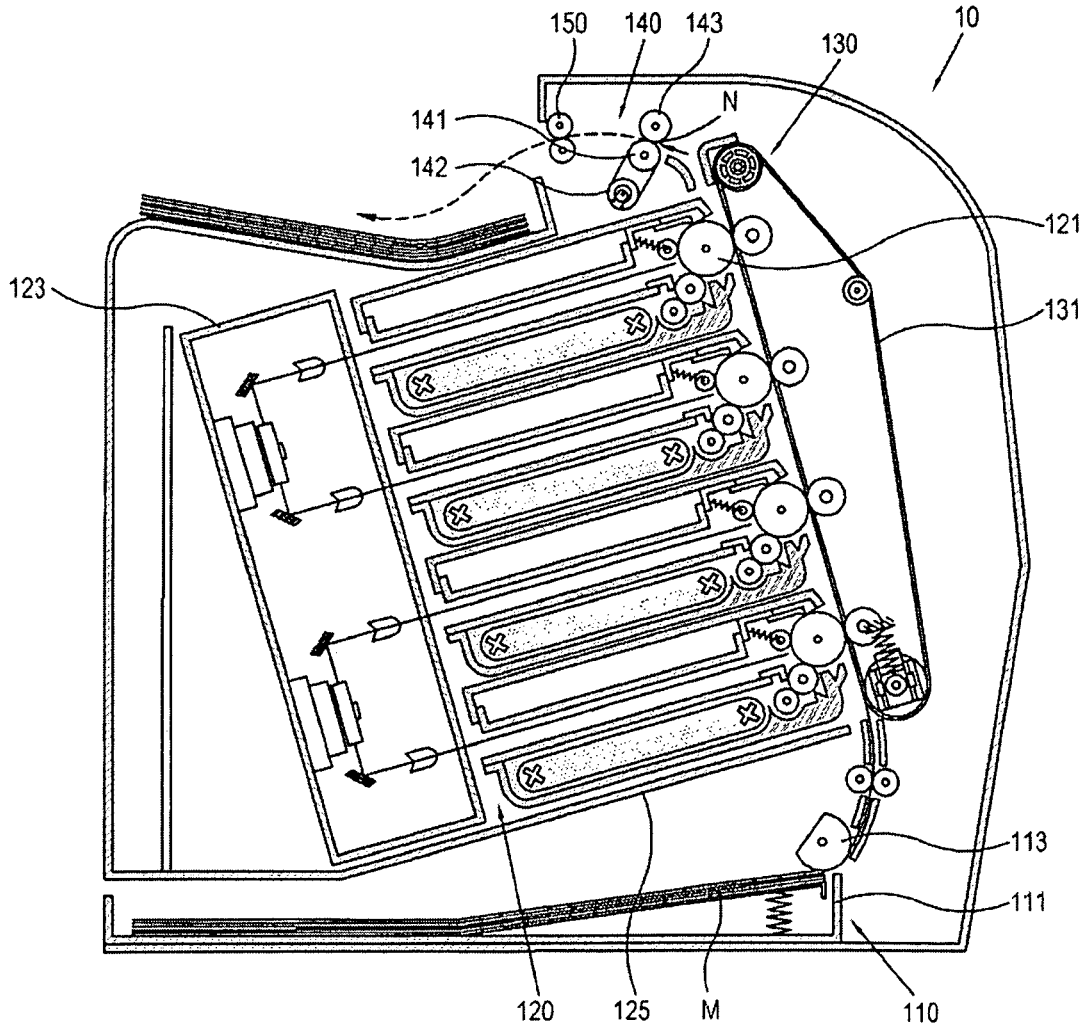
FIG. 1 illustrates a general image forming apparatus in which the embodiments of the present invention may be practiced.

Reference will now be made in detail to the embodiments of the present invention, examples of which are illustrated in the accompanying drawings, wherein like reference numerals refer to like elements throughout. The embodiments are described below so as to explain the present invention by referring to the figures.

Figure 2:
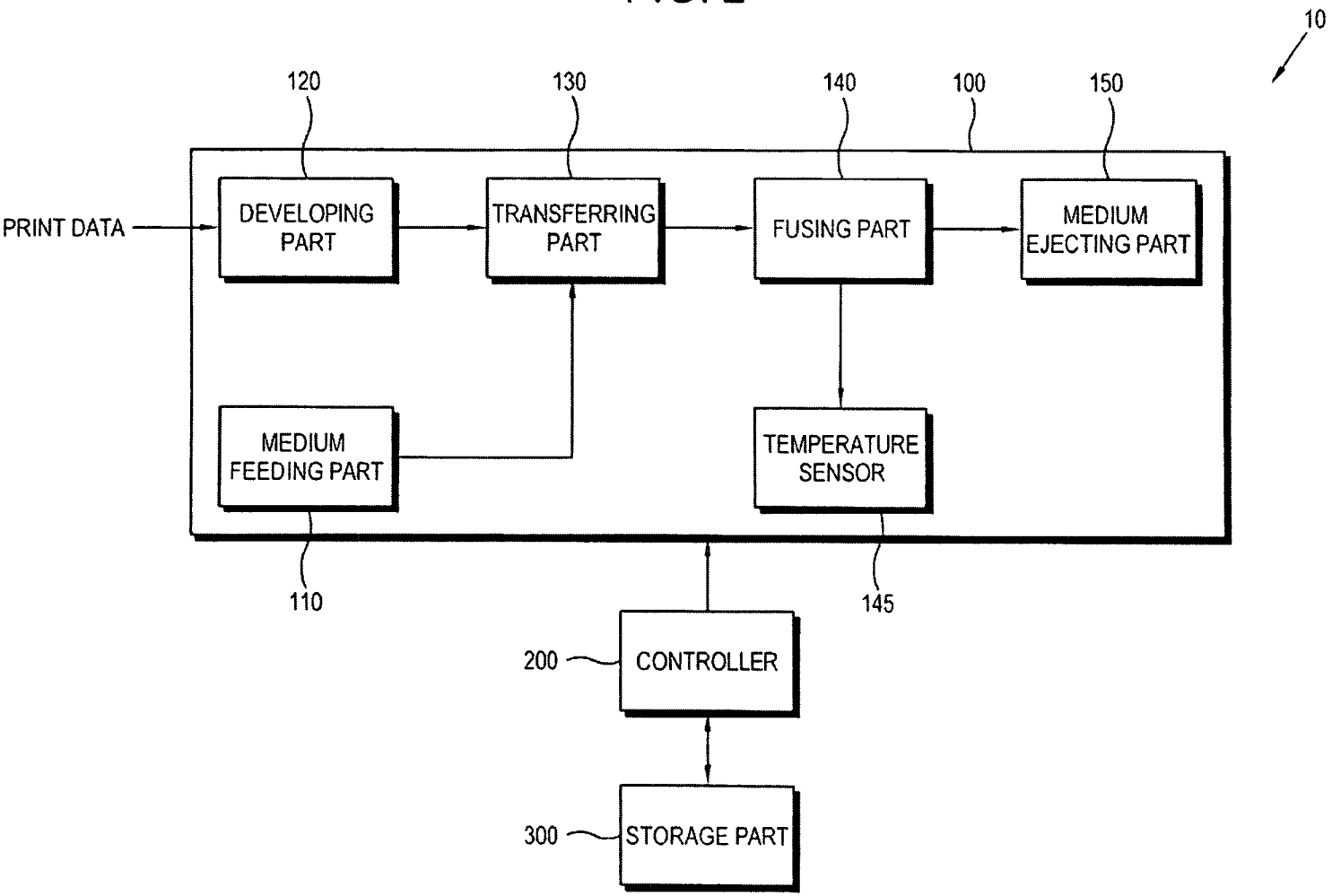
FIG. 2 is a block diagram of an image forming apparatus according to an embodiment of the present invention.

FIG. 2 is a block diagram of an image forming apparatus 10 according to an embodiment of the present invention. As shown therein, the image forming apparatus 10 may include an image forming part 100 and a controller 200. The image forming part 100 includes a medium feeding part 110, a developing part 120, a transferring part 130, a fusing part 140 and a medium ejecting part 150. According to an embodiment of the present invention, the image forming apparatus 10 may be realized as a printer, copier, facsimile, a multifunction peripheral, or the like, that transfers an image onto a recording medium, e.g., sheet(s) of paper.

Referring to FIGS. 1 and 2, the medium feeding part 110 may include a cassette 111 to be loaded with one or more sheets of recording medium M, and a pickup roller 113 to pick up the recording medium from the cassette 111. When a print instruction is received, the pickup roller 113 picks up the recording medium at a predetermined point of time after the print instruction, and sends it to the transferring part 130.

The developing part 120 may include a photosensitive body 121; a light scanning unit 123 which emits light to form a latent image on the photosensitive body 121; a developing unit 125 which develops the latent image with toner. The photosensitive body 121, the light scanning unit 123 and the developing unit 125 are placed along a feeding path of the recording medium, and may be provided in plurality for developing color images.

The transferring part 130 may be placed opposite to the plurality of photosensitive bodies 121 so that the recording medium M can be fed along the feeding path between the transferring part 130 and the photosensitive body 121. The transferring part 130 transfers the toner from the photosensitive body 121 to the recording medium M. To this end, the transferring part 130 may also include a transferring belt 131 disposed facing the plurality of the photosensitive bodies 121. Alternatively, the images from the photosensitive bodies 121 may be transferred in a manner overlapping one another onto an intermediary belt, and the overlapped image may then be transferred to the recording medium.

The fusing part 140 includes a fusing nip N formed between, and due to pressing contact between, the rollers 141 and 143. The fusing part 140 heats and/or presses the recording medium M passing through the fusing nip N, thereby fixing the toner on the recording medium M to obtain a permanent image. More particularly, the fusing part 140 may include a heating roller 141, which is provided with a heater 142, and which generates heat, and a pressing roller 143, which pressingly contacts the heating roller 141, and which forms the fusing nip N. The heating roller 141 and the pressing roller 143 rotate while being pressed against each other with a predetermined pressure, so that heat and pressure are applied to the toner transferred onto the recording medium M to thereby fix an image on the recording medium M.

According to this embodiment, the heater 142 may be provided as a halogen lamp, a heat wire, an induction heater, or the like, in the heating roller 141. Further, the image forming apparatus 10 may include one or more pressing rollers 143 each having a diameter, e.g., less than 20 millimeters.

The image forming apparatus 10 may require a certain fusing temperature in order to properly fuse the toner onto the recording medium. In an embodiment, the image forming apparatus 10 may maintain a fusing temperature of about 180 degrees centigrade while performing a printing job at a reference printing speed (e.g., at 100% speed) since the fixability of the toner may be secured as long as the temperature is above a minimum fusing temperature, e.g., of about 160 degrees centigrade.

The fixability of the image is effected by not only the fusing temperature but also the pressure and the time during which the recording medium M dwells in the fusing nip (hereinafter, referred to as a "dwell time"). For example, if the image forming apparatus 10 includes two pressing rollers 143, the heating roller 141 and the pressing rollers 143 form two fusing nips, in which the dwell time can be calculated as follows.

$$\text{Dwell Time}=(\text{first fusing nip section length}+\text{second fusing nip section length})/\text{printing speed} \quad \text{[Equation 1]}$$

In other words, if the printing speed decreases, the dwell time increases, thereby enhancing the fixability. On the other hand, if the printing speed increases, the dwell time decreases, thereby lowering the fixability.

The medium ejecting part 150 eject the recording medium out of the image forming apparatus 10, which may be realized as a medium ejecting roller or rollers. In an embodiment, a first print output time (FPOT) may be defined as the time duration from the start of warming up the image forming apparatus 10 to the ejecting of the first recording medium having an image fixed thereto, i.e., the time for completing the printing operation on the first recording medium.

The controller 200 may perform the general control of the image forming apparatus 10. The controller 200 may include, for example, a microprocessor, microcontroller, or the like, that are capable of executing computer instructions to implement the controlling of the operations of the image forming apparatus 10 as described herein, and may also include one or more memory devices, which may be for example a random access memory (RAM), a read-only-memory (ROM), or the like, to store the instructions to be executed by the microprocessor or the microcontroller, and to store other data useful in controlling the operation of the image forming apparatus 10.

According to an embodiment, when the image forming apparatus 10 is in a cold start printing state, i.e., starting the warming up after receiving a printing instruction, the controller 200 may accelerate the timing for picking lip the recording medium M so that the recording medium M can picked up earlier than the normal pick up timing that would correspond to the normal reference ejecting time, and also decreases the printing speed so as to allow the toner image to be fixed on the recording medium M even at a lower fusing temperature, i.e., before reaching the normal fusing temperature.

For example, the image forming apparatus 10 having a printing speed of 165 mm/sec and a fusing temperature of 180 degrees centigrade takes an FPOT of 23.5 seconds to warm up and to perform the printing job at the full printing speed (i.e., 100%), of which the image forming apparatus is capable (hereinafter referred to as the "reference printing speed") from the time of receiving the printing instruction. Conventionally, the timing for picking up the recording medium M may be set in consideration of the time for preheating the fusing part 140, for example, after a lapse of 6 seconds from starting of the warming-up.

In the image forming apparatus 10 according to an embodiment of the present invention, the timing for picking up the recording medium M may be accelerated. That is, for example, the recording medium M may be picked up after a lapse of only 2 seconds from starting the warming-up, thereby shortening the FPOT. As the pick-up time is accelerated, because by the time the recording medium M reaches the fusing part 140, the fusing part 140 may not have reached the proper fusing temperature, and thus the fixability of the image may suffer. Accordingly, the controller 200 may perform the printing operation at a lower printing speed, for example, at 66 mm/sec, which is 40% of the reference printing speed, to compensate for the lowered fusing temperature.

The point in time for picking up the recording medium M may be determined in consideration of the rate of temperature rise. For example, the temperature increase rate may be considered to be, e.g., 9.5° C./sec. Further, in one embodiment, the reduced printing speed, e.g., 40% of the reference printing speed, may be set taking into account the minimum revolution per minute (RPM) the motor for the light scanning unit.

By accelerating the pickup timing and decreasing the printing speed, the FPOT may be shortened, e.g., to 17 seconds or less. Although the lowered printing speed increases the time from the pickup point to the medium ejecting point, the pickup point occurs earlier in time so that the FPOT as a whole including the warming-up time can be shortened. The lowered fusing temperature may be, e.g., approximately 140 degrees centigrade.

Even though the fusing temperature may be lower, by picking up the recording medium sooner and reducing the printing speed as described above, the dwell time during which the printing medium M dwells in the fusing nip(s) N may be prolonged, so that the proper fixability of the image can be achieved even at the lower fusing temperature.

Figure 3:
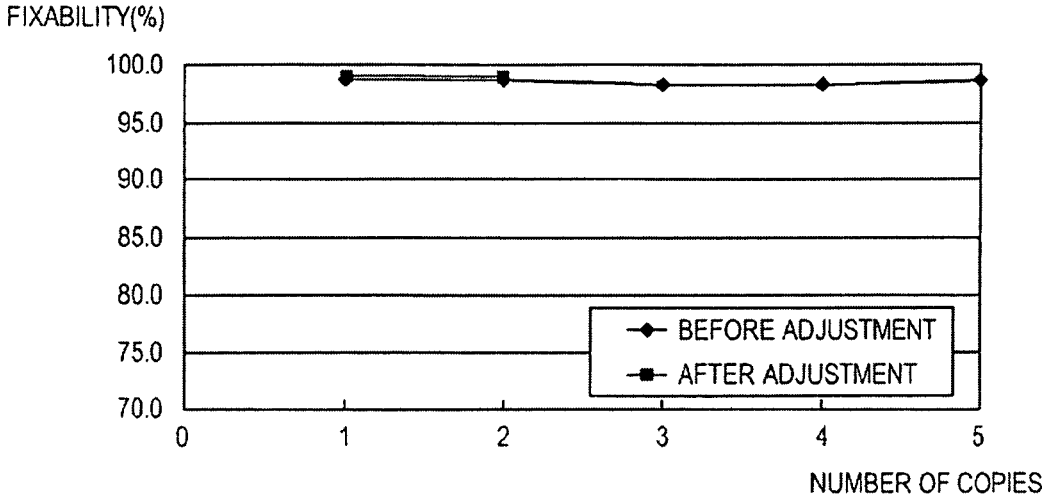
FIG. 3 is a graph showing fixability before and after adjusting a pickup point and a printing speed according to an embodiment of the present invention.

Table 1 and FIG. 3 illustrate the fixability before and after the adjustment of the recording medium pickup timing and the printing speed according to an embodiment of the present invention.

TABLE 1

| | Number of copies | | | | |
|---|---|---|---|---|---|
| | 1 | 2 | 3 | 4 | 5 |
| Before Adjustment | 98.7 | 98.5 | 98.1 | 98.1 | 97.8 |
| After Adjustment | 98.9 | 98.8 | | | |

As shown in Table 1 and FIG. 3, A shorter FPOT may be realized while the fixability of an image may be maintained at close to 100%, which is not substantially different from the fixability conventionally realized (i.e., before the adjustment), after the adjustments of pickup timing and the printing speed are made according to the embodiment of the present invention.

While, for the purpose of illustration, the reduction of the printing speed to 40% of the reference printing speed is described in the above example, it should be understood that the scope of the application of the present invention is not so limited, and that the printing speed can be reduced to other speeds, for example, to 60%, 80% of, or any other reduced speed in relation to, the reference printing speed. According to an embodiment, the values for the lowered printing speed and the corresponding earlier pickup timing may be stored in a storage part 300, and may be read from the storage part 300 by the controller 200 to control the printing operation to realize the shortened FPOT. The storage part 300 may be any memory device, e.g., a RAM, ROM, Flash Memory, Hard Disk Drive, or the like, and may also be a memory device embedded in the controller 200. In another embodiment, the reduced printing speed and the corresponding earlier recording medium pickup timing may be calculated by the controller 200.

According to an embodiment, the controller 200 may implement the above described adjustments to the recording medium pickup timing and the printing speed for the first recording medium M after the start of the warming up, and may control the subsequent printing operation on the basis of the reference printing speed and the reference pickup timing. The reference pickup timing as used herein may be the timing of recording medium pickup when the printing operations are performed while the image forming apparatus is in ready mode, in which no warming-up is required, and may be, for example, the time when the ejection of the previous recording medium is detected. That is, without regard to the fusing temperature, the pickup roller 113 may pick up the next recording medium upon detecting the ejection of the previous recording medium.

In an embodiment, the image forming part 100 may include a temperature sensor 145 to sense the temperature of the fusing part 140.

The temperature sensor 145, which may be placed to sense the temperature of external circumferences of the heating roller 141 and/or the pressing roller 143 of the fusing part 140, may be, e.g., a thermistor that may exhibit relatively large change in its resistance in response to small changes in the temperature.

The controller 200 may compare the temperature sensed by the temperature sensor 145 with a predetermined reference temperature T0, and may adjust the timing for picking up the recording medium M and the printing speed on the basis of the result of the comparison.

For example, when the sensed temperature is higher than the reference temperature T0 after starting the warming-up, the controller 200 controls the printing operation to be performed on the basis of the reference pickup timing and the reference printing speed. It is possible that, such as would be the case when the image forming apparatus had just been placed in the standby mode from a ready mode, even though the image forming apparatus 10 starts warming up in response to the printing instruction while in a standby mode, there may not be a need for preheating the fusing part 140.

The controller 200 may thus compare the temperature sensed by the temperature sensor 145 with the reference temperature T0, and adjust the pickup timing and the printing speed only if the sensed temperature is lower than the reference temperature T0. In an embodiment, the reference temperature T0 may be set to be, e.g., about 130 degrees centigrade.

The controller 200 may further adjust the transfer pressure and/or the optical power of the light scanning unit to level(s) corresponding to the lowered printing speed.

Figure 4:
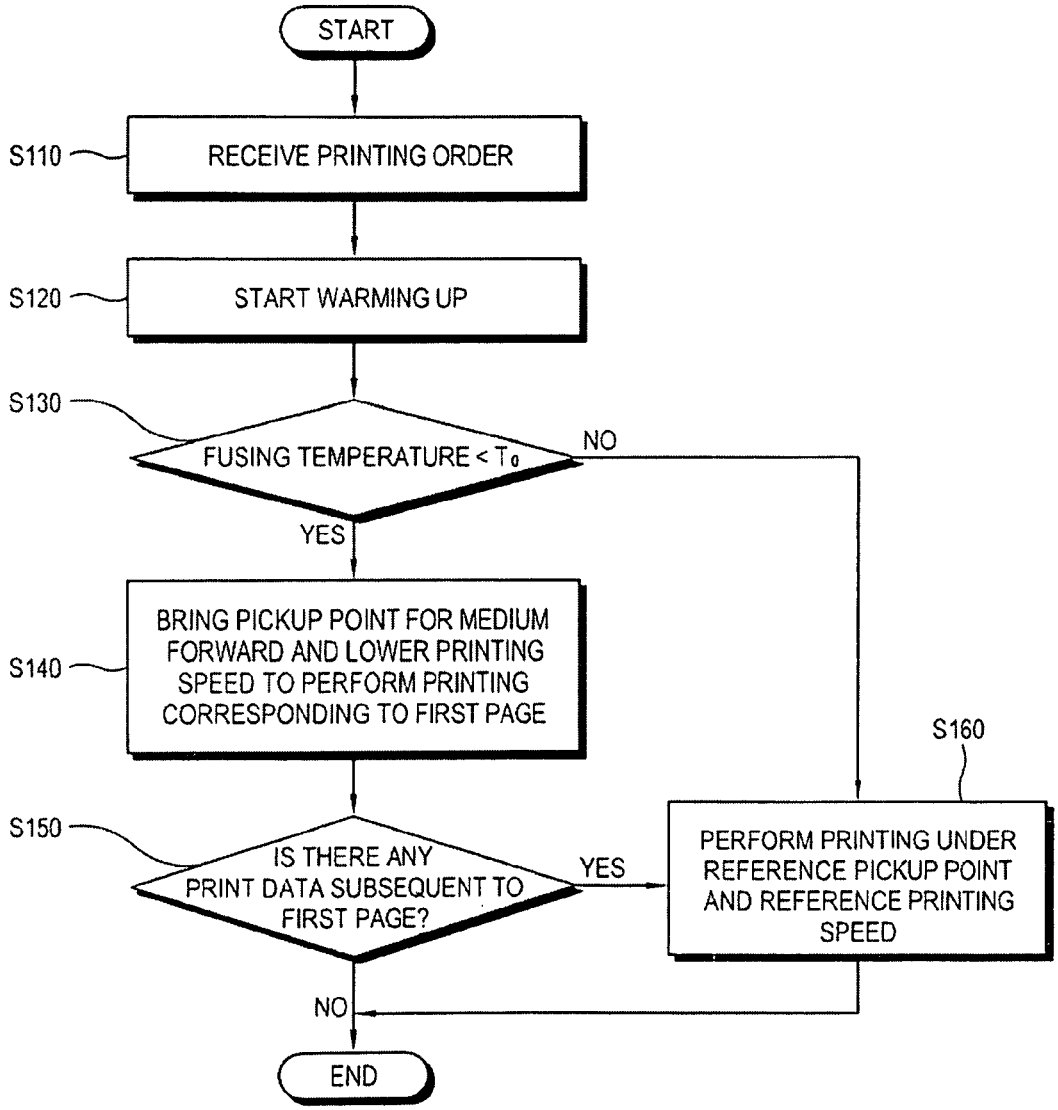
FIG. 4 is a flowchart of a control method for the image forming apparatus according to an embodiment of the present invention.

Referring to FIG. 4, an example of the control method of the image forming apparatus 10 with the above described configuration will be described.

At operation S110, the image forming apparatus 10 may receive a printing instruction, e.g., from a host computer or the like.

At operation S120, the controller 200 starts warming up if cold start printing is need such as, e.g., the image forming apparatus 10 is in a power-off mode or a standby mode.

At operation S130, the controller 200 compares the fusing temperature with the reference temperature T0.

If it is determined at the operation 130 that the fusing temperature is lower than the reference temperature, at operation S140, the controller 200 accelerates the picking up of the recording medium M and lowers the printing speed in performing the printing operation corresponding to the first page.

At operation S150 the controller 200 determines whether there is print data subsequent to the first page.

If it is determined at the operation S150 that there is no print data subsequent to the first page, the printing job is completed. On the other hand, if it is determined at the operation S150 that there is print data subsequent to the first page, at operation S160 the controller 200 controls the printing operations corresponding to the subsequent print data oil the basis of the reference pickup timing and the reference printing speed.

If it is determined at the operation S130 that the fusing temperature is higher than the reference temperature T0, at operation S160 the controller 200 controls the printing operation to be performed on the basis of the reference pickup point and the reference printing speed.

As described above, the present invention provides an image forming, apparatus, and a control method thereof, that are capable of shortening the first print output time (FPOT).

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An image forming apparatus comprising:

an image forming part configured to perform a printing operation that comprises picking up a recording medium, forming an image on the recording medium, and discharging the recording medium on which the image has been formed out of the image forming apparatus, the image forming part including a fusing part configured to fix the image on the recording medium by applying at least heat at a temperature; and a controller configured to control the image forming part, if the image forming apparatus receives a printing data and starts warming up, to pick up a first page of the recording medium corresponding to the printing data at a warm up pick up timing and to perform the printing operation at a warm up printing speed, the controller being configured to control the image forming part to pick up remaining recording medium, subsequent to the first page, corresponding to the print data at a reference pick up timing and to perform the printing operation at a reference printing speed, the reference pick up timing corresponding to a reference duration according to the reference printing speed, the warm up pick up timing being earlier than the reference pick up timing, the warm up printing speed being slower than the reference printing speed and a warm up duration according to the warm up printing speed being longer than the reference duration;

wherein the subsequent pages are printed at a reference speed regardless of the number of pages in the print data and the temperature of image forming apparatus.

2. The image forming apparatus according to claim 1, wherein:

the image forming part further comprises a temperature sensor to sense the temperature, and wherein the controller is configured to cause the image forming part to perform the printing operation at the warm up printing speed when the temperature sensed by the sensor is lower than the reference temperature for the first page of the printing data.

3. The image forming apparatus according to claim 1, wherein:

the fusing part comprises a heating roller and at least one pressing roller, the pressing roller being in pressing contact with the heating roller to form a fusing nip, the fusing nip contributes to a total dwell time during which the recording medium is placed in the fusing nip to thereby enhance fixability of the image on the recording medium.

4. The image forming apparatus according to claim 3, wherein each of the at least one pressing rollers has a diameter less than 20 millimeters.

5. The image forming apparatus according to claim 1, further comprising:

a storage part in communicative connection with the controller, the storage part having stored therein data indicating a value for at least the warm up printing speed and the warm up pick up timing.

6. The image forming apparatus according to claim 2, wherein:

the controller is configured to, upon receipt of a print instruction from an external host device, perform a comparison of an output of the sensor with the reference temperature, and based on the comparison determines whether to control the image forming part to perform the printing operation at the reference printing speed or at the warm up printing speed.

7. A method of controlling an image forming apparatus that performs a printing operation that comprises picking up a recording medium, forming an image on the recording medium, and discharging the recording medium on which the image has been formed out of the image forming apparatus, the image forming apparatus including a fusing unit configured to fix the image on the recording medium by applying at least heat at a temperature, the method comprising:

receiving a printing data and starting warming up;

picking up a first page of the recording medium corresponding to the printing data at a warm up pick up timing and performing the printing operation at a warm up printing speed;

picking up the remaining recording medium, subsequent to the first page, corresponding to the print data at a reference pick up timing and performing the printing operation at a reference printing speed, the reference pick up timing corresponding to a reference duration according to the reference printing speed, and wherein the warm up pick up timing being earlier than the reference pick up timing, the warm up printing speed being slower that the reference printing speed and a warm up duration according to the warm up printing speed being longer than the reference duration;

wherein the subsequent pages are printed at a reference speed regardless of the number of pages in the print data and the temperature of image forming apparatus.

8. The method according to claim 7, further comprising:

sensing the temperature with a temperature sensor;

comparing the temperature sensed by the temperature sensor with a reference temperature; and determining whether the temperature is above or below the reference temperature.

9. The method according to claim 7, further comprising performing the printing operation by routing the recording medium through a plurality of fusing nips formed between a heating roller and a plurality of pressing rollers of the fusing unit, each of the plurality of fusing nips contributing to a total dwell time during which the recording medium is placed in the plurality of fusing nips to thereby enhance fixability of the image on the recording medium.

10. The method according to claim 8, further comprising performing the printing operation by performing a plurality of printing operations in succession, wherein, if the temperature is determined to be above the reference temperature, each of the plurality of printing operations is performed at the reference printing speed and if the temperature is below the reference temperature the first page of the data of the first printing operation is performed at the warm-up printing speed.

11. A non-transitory computer readable medium having stored thereon one or more sequences of instructions, execution of which by one or more processors causes the one, or more processors to implement a method of controlling an image forming apparatus that performs a printing operation that comprises picking up a recording medium, forming an image on the recording medium, and discharging the recording medium on which the image has been formed out of the image forming apparatus, the image forming apparatus including a fusing unit configured to fix the image on the recording medium by applying at least heat at a temperature, the method comprising:

receiving a printing data and starting warming up;

picking up a first page of the recording medium corresponding to the printing data at a warm up pick up timing and performing the printing operation at a warm up printing speed;

picking up the remaining recording medium, subsequent to the first page, corresponding to the print data at a reference pick up timing and performing the printing operation at a reference printing speed, the reference pick up timing corresponding to a reference duration according to the reference printing speed, and wherein the warm up pick up timing being earlier than the reference pick up timing, the warm up printing speed being slower that the reference printing speed and a warm up duration according to the warm up printing speed being longer than the reference duration;

wherein the subsequent pages are printed at a reference speed regardless of the number of pages in the print data and the temperature of image forming apparatus.

12. The non-transitory computer readable medium according to claim 11, further comprising:

sensing the temperature with a temperature sensor;

comparing the temperature sensed by the temperature sensor with a reference temperature; and determining whether the temperature is above or below the reference temperature.

13. The non-transitory computer readable medium according to claim 11, further comprising performing the printing operation by routing the recording medium through a plurality of fusing nips formed between a heating roller and a plurality of pressing rollers of the fusing unit, each of the plurality of fusing nips contributing to a total dwell time during which the recording medium is placed in the plurality of fusing nips to thereby enhance fixability of the image on the recording medium.

14. The non-transitory computer readable medium according to claim 11, further comprising performing the printing operation by performing a plurality of printing operations in succession, wherein, if the temperature is determined to be above the reference temperature, each of the plurality of printing operations is performed at the reference printing speed and if the temperature is below the reference temperature the first page of the data of the first printing operation is performed at the warm-up printing speed.

15. An image forming apparatus comprising:

an image forming part which picks up a recording medium at a predetermined pickup timing and forms an image at a predetermined printing speed; and a controller which brings the timing for picking up a first page of the recording medium forward in advance of a reference timing for ejecting the recording medium and lowers the printing speed to correspond to a fusing temperature lowered as the pickup timing is brought forward when the image forming apparatus starts warming up, the warm up pick up timing being earlier than the reference pick up timing, wherein the controller controls the image forming part to pick up the remaining recording medium, subsequent to the first page, at the reference pick up timing, and to perform the printing operation at a reference printing speed;

wherein the subsequent pages are printed at a reference speed regardless of the number of pages in the print data and the temperature of image forming apparatus.

* * * * *

UNITED STATES PATENT AND TRADEMARK OFFICE

CERTIFICATE OF CORRECTION

PATENT NO. : 8,634,735 B2
APPLICATION NO. : 12/268621
DATED : January 21, 2014
INVENTOR(S) : Ko It is certified that error appears in the above-identified patent and that said Letters Patent is hereby corrected as shown below:

In the Claims

Column 8, Lines 23-24, In Claim 11, delete "one, or more" and insert -- one or more --, therefor.

Signed and Sealed this
First Day of July, 2014

Michelle K. Lee

Michelle K. Lee
*Deputy Director of the United States Patent and Trademark Office*